US007253811B2

(12) United States Patent
Tretter et al.

(10) Patent No.: US 7,253,811 B2
(45) Date of Patent: Aug. 7, 2007

(54) GENERATING AND DISPLAYING SPATIALLY OFFSET SUB-FRAMES

(75) Inventors: Daniel R. Tretter, San Jose, CA (US); Niranjan Damera-Venkata, Mountain View, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 276 days.

(21) Appl. No.: 10/672,544

(22) Filed: Sep. 26, 2003

(65) Prior Publication Data

US 2005/0068335 A1 Mar. 31, 2005

(51) Int. Cl.
*G09G 5/00* (2006.01)
*G09G 5/10* (2006.01)
*G09G 5/02* (2006.01)

(52) U.S. Cl. ..... 345/204; 345/690; 345/691; 345/694

(58) Field of Classification Search ..... 345/690–699, 345/619, 660, 670, 672, 674, 204, 175
See application file for complete search history.

(56) References Cited

U.S. PATENT DOCUMENTS

| | | | |
|---|---|---|---|
| 4,662,746 | A | 5/1987 | Hornbeck |
| 4,956,619 | A | 9/1990 | Hornbeck |
| 5,061,049 | A | 10/1991 | Hornbeck |
| 5,083,857 | A | 1/1992 | Hornbeck |
| 5,490,009 | A | 2/1996 | Venkateswar et al. |
| 5,689,283 | A | 11/1997 | Shirochi |
| 5,719,594 | A | 2/1998 | Potu |
| 5,751,379 | A | 5/1998 | Markandey et al. |
| 5,842,762 | A | 12/1998 | Clarke |
| 5,897,191 | A | 4/1999 | Clarke |
| 5,978,518 | A | 11/1999 | Oliyide et al. |
| 6,025,951 | A | 2/2000 | Swart et al. |
| 6,104,375 | A | 8/2000 | Lam |
| 6,141,039 | A | 10/2000 | Poetsch |
| 6,184,969 | B1 | 2/2001 | Fergason |
| 6,219,017 | B1 | 4/2001 | Shimada et al. |
| 6,239,783 | B1 | 5/2001 | Hill et al. |
| 6,243,055 | B1 | 6/2001 | Fergason |
| 6,313,888 | B1 | 11/2001 | Tabata |

(Continued)

FOREIGN PATENT DOCUMENTS

| | | |
|---|---|---|
| EP | 0712243 | 5/1996 |

(Continued)

OTHER PUBLICATIONS

A. Yasuda et al., "FLC Wobbling for High-Resolution Projectors", Journal of the SID May 3, 1997, pp. 299-305.

(Continued)

*Primary Examiner*—Kee M. Tung
*Assistant Examiner*—Chante Harrison

(57) ABSTRACT

A method of displaying images with a display device includes receiving image data for a plurality of image frames. At least one sub-frame for each image frame is generated based on the received image data. The sub-frames for each image frame in a first set of the plurality of image frames are displayed at a first plurality of spatially offset positions. The sub-frames for each image frame in a second set of the plurality of image frames are displayed at a second plurality of spatially offset positions that is different than the first plurality of spatially offset positions.

20 Claims, 9 Drawing Sheets

U.S. PATENT DOCUMENTS

| | | | | |
|---|---|---|---|---|
| 6,323,880 | B1 * | 11/2001 | Yamada | 345/690 |
| 6,373,477 | B1 * | 4/2002 | Van Dijk | 345/204 |
| 6,384,816 | B1 | 5/2002 | Tabata | |
| 6,393,145 | B2 | 5/2002 | Betrisey et al. | |
| 6,710,772 | B2 * | 3/2004 | Van Dijk et al. | 345/204 |
| 6,894,664 | B2 * | 5/2005 | Thebault et al. | 345/690 |
| 2002/0054031 | A1 * | 5/2002 | Elliott et al. | 345/204 |
| 2002/0156364 | A1 | 10/2002 | Madore | |
| 2003/0020809 | A1 | 1/2003 | Gibbon et al. | |
| 2003/0090597 | A1 | 5/2003 | Katoh et al. | |
| 2003/0137499 | A1 * | 7/2003 | Iisaka | 345/204 |
| 2004/0027363 | A1 * | 2/2004 | Allen | 345/698 |
| 2004/0046752 | A1 * | 3/2004 | Willis et al. | 345/204 |
| 2004/0061710 | A1 * | 4/2004 | Messing et al. | 345/698 |
| 2004/0201598 | A1 * | 10/2004 | Eliav et al. | 345/698 |
| 2006/0007219 | A1 * | 1/2006 | Sakashita | 345/204 |

FOREIGN PATENT DOCUMENTS

| | | |
|---|---|---|
| EP | 0790514 | 8/1997 |
| EP | 1001306 A2 | 5/2000 |
| EP | 1388839 | 2/2004 |
| JP | 06038246 | 2/1994 |

OTHER PUBLICATIONS

T. Tokita et al., "P-108: FLC Resolution-Enhancing Device for Projection Displays", SID 02 Digest 2002, pp. 638-641.

L.M. Chen "One-Panel Projectors", pp. 221-226. Date unknown.

U.S. Appl. No. 10/213,555, filed on Aug. 7, 2002, entitled "Image Display System and Method".

U.S. Appl. No. 10/242,195, filed Sep. 11, 2002, entitled "Image Display System and Method".

U.S. Appl. No. 10/242,545, filed on Sep. 11, 2002, entitled "Image Display System and Method".

R.J. Gove, "DMD Display Systems: The Impact of an All-Digital Display," Society for Information Display International Symposium, (Jun. 1994.

* cited by examiner

GENERATING AND DISPLAYING SPATIALLY OFFSET SUB-FRAMES

CROSS-REFERENCE TO RELATED APPLICATIONS

This application is related to U.S. patent application Ser. No. 10/213,555, filed on Aug. 7, 2002, entitled IMAGE DISPLAY SYSTEM AND METHOD; U.S. patent application Ser. No. 10/242,195, filed on Sep. 11, 2002, entitled IMAGE DISPLAY SYSTEM AND METHOD; U.S. patent application Ser. No. 10/242,545, filed on Sep. 11, 2002, entitled IMAGE DISPLAY SYSTEM AND METHOD; U.S. patent application Ser. No. 10/631,681, filed on Jul. 31, 2003, entitled GENERATING AND DISPLAYING SPATIALLY OFFSET SUB-FRAMES; U.S. patent application Ser. No. 10/632,042, filed on Jul. 31, 2003, entitled GENERATING AND DISPLAYING SPATIALLY OFFSET SUB-FRAMES; and U.S. patent application Ser. No. 10/672,845, filed on the same date as the present application, entitled GENERATING AND DISPLAYING SPATIALLY OFFSET SUB-FRAMES. Each of the above U.S. Patent Applications is assigned to the assignee of the present invention, and is hereby incorporated by reference herein.

FIELD OF THE INVENTION

The present invention generally relates to display systems, and more particularly to generating and displaying spatially offset sub-frames.

BACKGROUND OF THE INVENTION

A conventional system or device for displaying an image, such as a display, projector, or other imaging system, produces a displayed image by addressing an array of individual picture elements or pixels arranged in a pattern, such as in horizontal rows and vertical columns, a diamond grid, or other pattern. A resolution of the displayed image for a pixel pattern with horizontal rows and vertical columns is defined as the number of horizontal rows and vertical columns of individual pixels forming the displayed image. The resolution of the displayed image is affected by a resolution of the display device itself as well as a resolution of the image data processed by the display device and used to produce the displayed image.

Typically, to increase a resolution of the displayed image, the resolution of the display device as well as the resolution of the image data used to produce the displayed image must be increased. Increasing a resolution of the display device, however, increases a cost and complexity of the display device. In addition, higher resolution image data may not be available or may be difficult to generate.

SUMMARY OF THE INVENTION

One form of the present invention provides a method of displaying images with a display device. The method includes receiving image data for a plurality of image frames. At least one sub-frame for each image frame is generated based on the received image data. The sub-frames for each image frame in a first set of the plurality of image frames are displayed at a first plurality of spatially offset positions. The sub-frames for each image frame in a second set of the plurality of image frames are displayed at a second plurality of spatially offset positions that is different than the first plurality of spatially offset positions.

DETAILED DESCRIPTION OF THE PREFERRED EMBODIMENTS

In the following detailed description of the preferred embodiments, reference is made to the accompanying drawings, which form a part hereof, and in which is shown by way of illustration specific embodiments in which the invention may be practiced. It is to be understood that other embodiments may be utilized and structural or logical changes may be made without departing from the scope of the present invention. The following detailed description, therefore, is not to be taken in a limiting sense, and the scope of the present invention is defined by the appended claims.

Some display systems, such as some digital light projectors, may not have sufficient resolution to display some high resolution images. Such systems can be configured to give the appearance to the human eye of higher resolution images by displaying spatially and temporally shifted lower resolution images. The lower resolution images are referred to as sub-frames. Appropriate values are chosen for the sub-frames so that the displayed sub-frames are close in appearance to how the high-resolution image from which the sub-frames were derived would appear if directly displayed.

One embodiment of a display system that provides the appearance of enhanced resolution through temporal and spatial shifting of sub-frames is described in the above-cited U.S. patent applications, and is summarized below with reference to FIGS. 1-4E.

Figure 1:
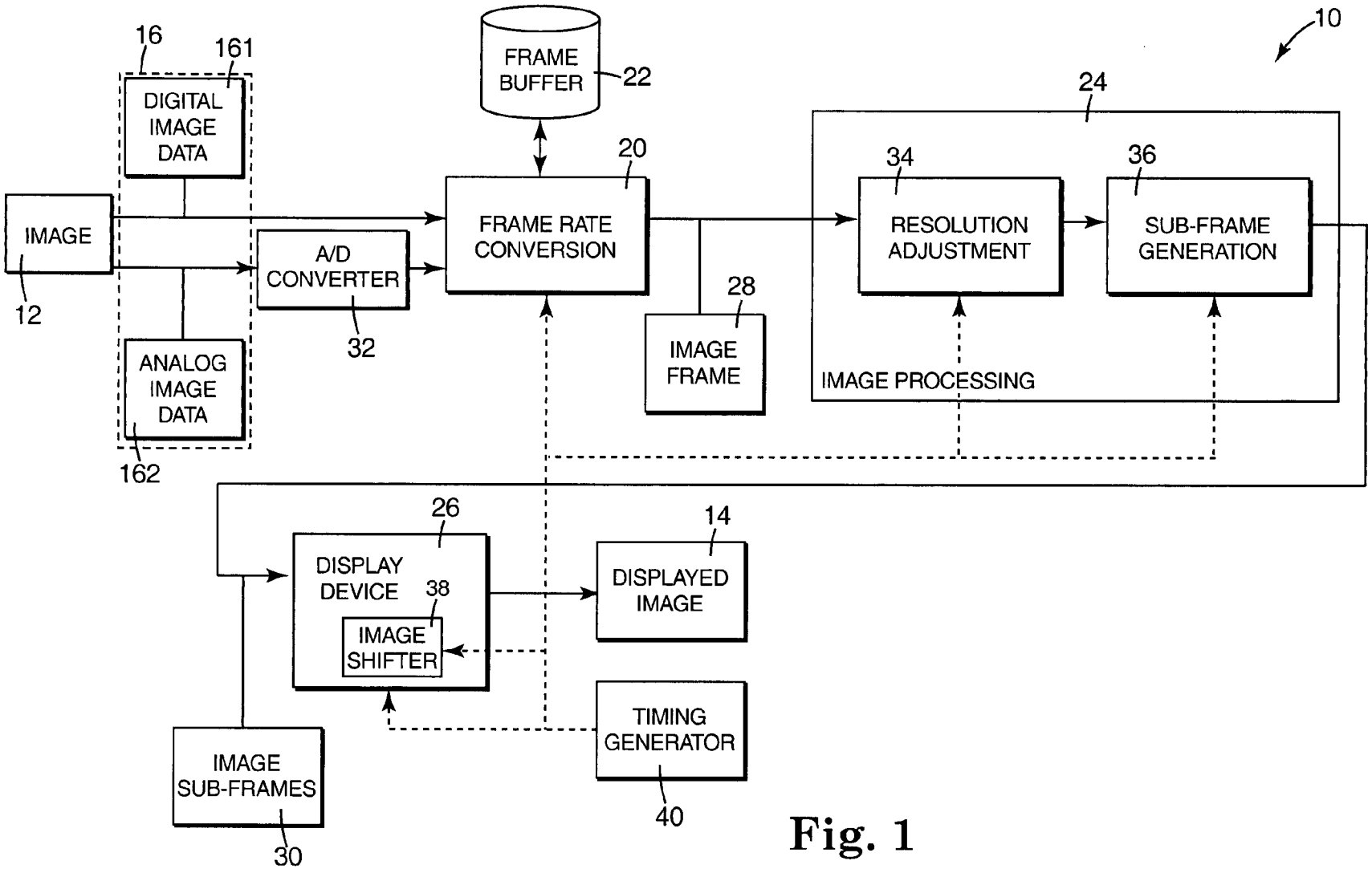
FIG. 1 is a block diagram illustrating an image display system according to one embodiment of the present invention.

FIG. 1 is a block diagram illustrating an image display system 10 according to one embodiment of the present invention. Image display system 10 facilitates processing of an image 12 to create a displayed image 14. Image 12 is defined to include any pictorial, graphical, or textural characters, symbols, illustrations, or other representation of information. Image 12 is represented, for example, by image data 16. Image data 16 includes individual picture elements or pixels of image 12. While one image is illustrated and described as being processed by image display system 10, it is understood that a plurality or series of images may be processed and displayed by image display system 10.

In one embodiment, image display system 10 includes a frame rate conversion unit 20 and an image frame buffer 22, an image processing unit 24, and a display device 26. As described below, frame rate conversion unit 20 and image frame buffer 22 receive and buffer image data 16 for image 12 to create an image frame 28 for image 12. Image processing unit 24 processes image frame 28 to define one or more image sub-frames 30 for image frame 28, and display device 26 temporally and spatially displays image sub-frames 30 to produce displayed image 14.

Image display system 10, including frame rate conversion unit 20 and image processing unit 24, includes hardware, software, firmware, or a combination of these. In one embodiment, one or more components of image display system 10, including frame rate conversion unit 20 and image processing unit 24, are included in a computer, computer server, or other microprocessor-based system capable of performing a sequence of logic operations. In addition, processing can be distributed throughout the system with individual portions being implemented in separate system components.

Image data 16 may include digital image data 161 or analog image data 162. To process analog image data 162, image display system 10 includes an analog-to-digital (A/D) converter 32. As such, AID converter 32 converts analog image data 162 to digital form for subsequent processing. Thus, image display system 10 may receive and process digital image data 161 or analog image data 162 for image 12.

Frame rate conversion unit 20 receives image data 16 for image 12 and buffers or stores image data 16 in image frame buffer 22. More specifically, frame rate conversion unit 20 receives image data 16 representing individual lines or fields of image 12 and buffers image data 16 in image frame buffer 22 to create image frame 28 for image 12. Image frame buffer 22 buffers image data 16 by receiving and storing all of the image data for image frame 28, and frame rate conversion unit 20 creates image frame 28 by subsequently retrieving or extracting all of the image data for image frame 28 from image frame buffer 22. As such, image frame 28 is defined to include a plurality of individual lines or fields of image data 16 representing an entirety of image 12. Thus, image frame 28 includes a plurality of columns and a plurality of rows of individual pixels representing image 12.

Frame rate conversion unit 20 and image frame buffer 22 can receive and process image data 16 as progressive image data or interlaced image data. With progressive image data, frame rate conversion unit 20 and image frame buffer 22 receive and store sequential fields of image data 16 for image 12. Thus, frame rate conversion unit 20 creates image frame 28 by retrieving the sequential fields of image data 16 for image 12. With interlaced image data, frame rate conversion unit 20 and image frame buffer 22 receive and store odd fields and even fields of image data 16 for image 12. For example, all of the odd fields of image data 16 are received and stored and all of the even fields of image data 16 are received and stored. As such, frame rate conversion unit 20 de-interlaces image data 16 and creates image frame 28 by retrieving the odd and even fields of image data 16 for image 12.

Image frame buffer 22 includes memory for storing image data 16 for one or more image frames 28 of respective images 12. Thus, image frame buffer 22 constitutes a database of one or more image frames 28. Examples of image frame buffer 22 include non-volatile memory (e.g., a hard disk drive or other persistent storage device) and may include volatile memory (e.g., random access memory (RAM)).

By receiving image data 16 at frame rate conversion unit 20 and buffering image data 16 with image frame buffer 22, input timing of image data 16 can be decoupled from a timing requirement of display device 26. More specifically, since image data 16 for image frame 28 is received and stored by image frame buffer 22, image data 16 can be received as input at any rate. As such, the frame rate of image frame 28 can be converted to the timing requirement of display device 26. Thus, image data 16 for image frame 28 can be extracted from image frame buffer 22 at a frame rate of display device 26.

In one embodiment, image processing unit 24 includes a resolution adjustment unit 34 and a sub-frame generation unit 36. As described below, resolution adjustment unit 34 receives image data 16 for image frame 28 and adjusts a resolution of image data 16 for display on display device 26, and sub-frame generation unit 36 generates a plurality of image sub-frames 30 for image frame 28. More specifically, image processing unit 24 receives image data 16 for image frame 28 at an original resolution and processes image data 16 to increase, decrease, or leave unaltered the resolution of image data 16. Accordingly, with image processing unit 24, image display system 10 can receive and display image data 16 of varying resolutions.

Sub-frame generation unit 36 receives and processes image data 16 for image frame 28 to define a plurality of image sub-frames 30 for image frame 28. If resolution adjustment unit 34 has adjusted the resolution of image data 16, sub-frame generation unit 36 receives image data 16 at the adjusted resolution. The adjusted resolution of image data 16 may be increased, decreased, or the same as the original resolution of image data 16 for image frame 28. Sub-frame generation unit 36 generates image sub-frames 30 with a resolution which matches the resolution of display device 26. Image sub-frames 30 are each of an area equal to image frame 28. Sub-frames 30 each include a plurality of columns and a plurality of rows of individual pixels representing a subset of image data 16 of image 12, and have a resolution that matches the resolution of display device 26.

Each image sub-frame 30 includes a matrix or array of pixels for image frame 28. Image sub-frames 30 are spatially offset from each other such that each image sub-frame 30 includes different pixels or portions of pixels. As such, image sub-frames 30 are offset from each other by a vertical distance and/or a horizontal distance, as described below.

Display device 26 receives image sub-frames 30 from image processing unit 24 and sequentially displays image sub-frames 30 to create displayed image 14. More specifically, as image sub-frames 30 are spatially offset from each other, display device 26 displays image sub-frames 30 in different positions according to the spatial offset of image sub-frames 30, as described below. As such, display device 26 alternates between displaying image sub-frames 30 for image frame 28 to create displayed image 14. Accordingly, display device 26 displays an entire sub-frame 30 for image frame 28 at one time.

In one embodiment, display device 26 performs one cycle of displaying image sub-frames 30 for each image frame 28. Display device 26 displays image sub-frames 30 so as to be spatially and temporally offset from each other. In one embodiment, display device 26 optically steers image sub-frames 30 to create displayed image 14. As such, individual pixels of display device 26 are addressed to multiple locations.

In one embodiment, display device 26 includes an image shifter 38. Image shifter 38 spatially alters or offsets the position of image sub-frames 30 as displayed by display device 26. More specifically, image shifter 38 varies the position of display of image sub-frames 30, as described below, to produce displayed image 14.

In one embodiment, display device 26 includes a light modulator for modulation of incident light. The light modulator includes, for example, a plurality of micro-mirror devices arranged to form an array of micro-mirror devices. As such, each micro-mirror device constitutes one cell or pixel of display device 26. Display device 26 may form part of a display, projector, or other imaging system.

In one embodiment, image display system 10 includes a timing generator 40. Timing generator 40 communicates, for example, with frame rate conversion unit 20, image processing unit 24, including resolution adjustment unit 34 and sub-frame generation unit 36, and display device 26, including image shifter 38. As such, timing generator 40 synchronizes buffering and conversion of image data 16 to create image frame 28, processing of image frame 28 to adjust the resolution of image data 16 and generate image sub-frames 30, and positioning and displaying of image sub-frames 30 to produce displayed image 14. Accordingly, timing generator 40 controls timing of image display system 10 such that entire sub-frames of image 12 are temporally and spatially displayed by display device 26 as displayed image 14.

Figure 2C:
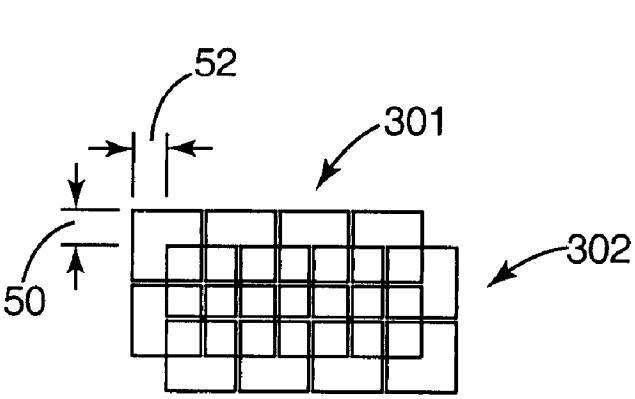
FIGS. 2A-2C are schematic diagrams illustrating the display of two sub-frames according to one embodiment of the present invention.
Figure 2B:
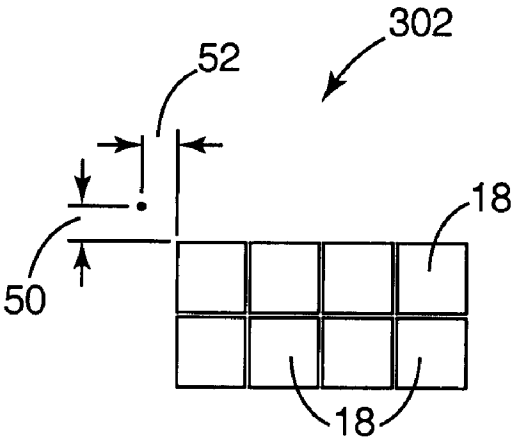
Figure 2A:
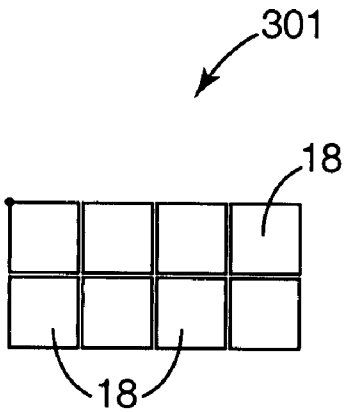

In one embodiment, as illustrated in FIGS. 2A and 2B, image processing unit 24 defines two image sub-frames 30 for image frame 28. More specifically, image processing unit 24 defines a first sub-frame 301 and a second sub-frame 302 for image frame 28. As such, first sub-frame 301 and second sub-frame 302 each include a plurality of columns and a plurality of rows of individual pixels 18 of image data 16. Thus, first sub-frame 301 and second sub-frame 302 each constitute an image data array or pixel matrix of a subset of image data 16.

In one embodiment, as illustrated in FIG. 2B, second sub-frame 302 is offset from first sub-frame 301 by a vertical distance 50 and a horizontal distance 52. As such, second sub-frame 302 is spatially offset from first sub-frame 301 by a predetermined distance. In one illustrative embodiment, vertical distance 50 and horizontal distance 52 are each approximately one-half of one pixel.

As illustrated in FIG. 2C, display device 26 alternates between displaying first sub-frame 301 in a first position and displaying second sub-frame 302 in a second position spatially offset from the first position. More specifically, display device 26 shifts display of second sub-frame 302 relative to display of first sub-frame 301 by vertical distance 50 and horizontal distance 52. As such, pixels of first sub-frame 301 overlap pixels of second sub-frame 302. In one embodiment, display device 26 performs one cycle of displaying first sub-frame 301 in the first position and displaying second sub-frame 302 in the second position for image frame 28. Thus, second sub-frame 302 is spatially and temporally displayed relative to first sub-frame 301. The display of two temporally and spatially shifted sub-frames in this manner is referred to herein as two-position processing.

In another embodiment, as illustrated in FIGS. 3A-3D, image processing unit 24 defines four image sub-frames 30 for image frame 28. More specifically, image processing unit 24 defines a first sub-frame 301, a second sub-frame 302, a third sub-frame 303, and a fourth sub-frame 304 for image frame 28. As such, first sub-frame 301, second sub-frame 302, third sub-frame 303, and fourth sub-frame 304 each include a plurality of columns and a plurality of rows of individual pixels 18 of image data 16.

Figure 3A:
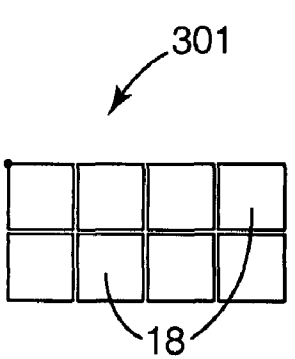
FIGS. 3A-3E are schematic diagrams illustrating the display of four sub-frames according to one embodiment of the present invention.
Figure 3B:
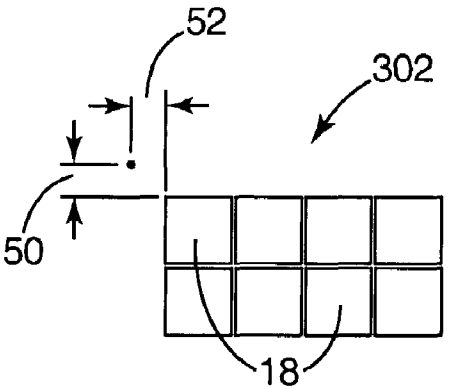
Figure 3C:
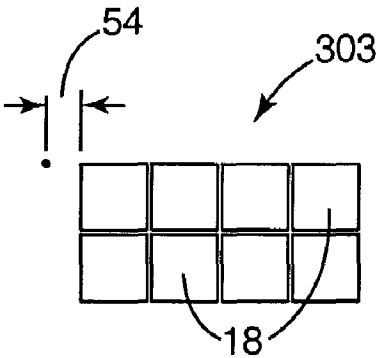
Figure 3D:
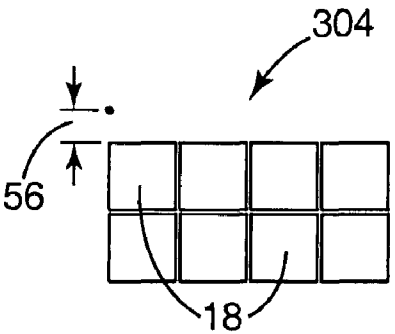

In one embodiment, as illustrated in FIGS. 3B-3D, second sub-frame 302 is offset from first sub-frame 301 by a vertical distance 50 and a horizontal distance 52, third sub-frame 303 is offset from first sub-frame 301 by a horizontal distance 54, and fourth sub-frame 304 is offset from first sub-frame 301 by a vertical distance 56. As such, second sub-frame 302, third sub-frame 303, and fourth sub-frame 304 are each spatially offset from each other and spatially offset from first sub-frame 301 by a predetermined distance. In one illustrative embodiment, vertical distance 50, horizontal distance 52, horizontal distance 54, and vertical distance 56 are each approximately one-half of one pixel.

Figure 3E:
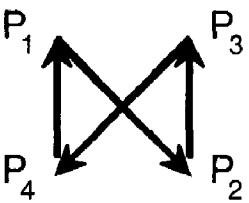

As illustrated schematically in FIG. 3E, display device 26 alternates between displaying first sub-frame 301 in a first position $P_1$, displaying second sub-frame 302 in a second position $P_2$ spatially offset from the first position, displaying third sub-frame 303 in a third position $P_3$ spatially offset from the first position, and displaying fourth sub-frame 304 in a fourth position $P_4$ spatially offset from the first position. More specifically, display device 26 shifts display of second sub-frame 302, third sub-frame 303, and fourth sub-frame 304 relative to first sub-frame 301 by the respective predetermined distance. As such, pixels of first sub-frame 301, second sub-frame 302, third sub-frame 303, and fourth sub-frame 304 overlap each other.

In one embodiment, display device 26 performs one cycle of displaying first sub-frame 301 in the first position, displaying second sub-frame 302 in the second position, displaying third sub-frame 303 in the third position, and displaying fourth sub-frame 304 in the fourth position for image frame 28. Thus, second sub-frame 302, third sub-frame 303, and fourth sub-frame 304 are spatially and temporally displayed relative to each other and relative to first sub-frame 301. The display of four temporally and spatially shifted sub-frames in this manner is referred to herein as four-position processing.

Figure 4A:
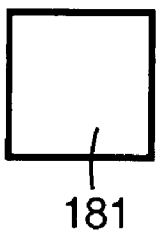
FIGS. 4A-4E are schematic diagrams illustrating the display of a pixel with an image display system according to one embodiment of the present invention.
Figure 4B:
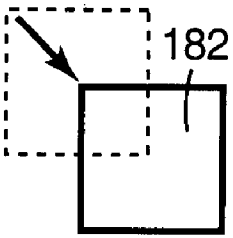
Figure 4C:
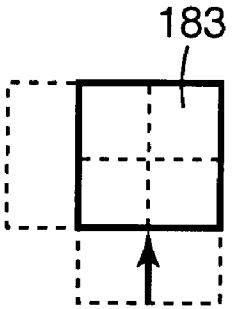
Figure 4D:
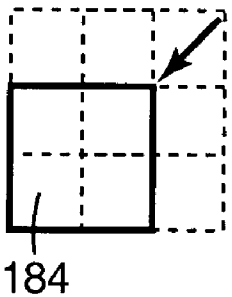
Figure 4E:
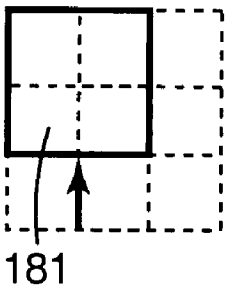

FIGS. 4A-4E illustrate one embodiment of completing one cycle of displaying a pixel 181 from first sub-frame 301 in the first position, displaying a pixel 182 from second sub-frame 302 in the second position, displaying a pixel 183 from third sub-frame 303 in the third position, and displaying a pixel 184 from fourth sub-frame 304 in the fourth position. More specifically, FIG. 4A illustrates display of pixel 181 from first sub-frame 301 in the first position, FIG. 4B illustrates display of pixel 182 from second sub-frame 302 in the second position (with the first position being illustrated by dashed lines), FIG. 4C illustrates display of pixel 183 from third sub-frame 303 in the third position (with the first position and the second position being illustrated by dashed lines), FIG. 4D illustrates display of pixel 184 from fourth sub-frame 304 in the fourth position (with the first position, the second position, and the third position being illustrated by dashed lines), and FIG. 4E illustrates display of pixel 181 from first sub-frame 301 in the first position (with the second position, the third position, and the fourth position being illustrated by dashed lines).

Sub-frame generation unit 36 (FIG. 1) generates sub-frames 30 based on image data in image frame 28. It will be understood by a person of ordinary skill in the art that functions performed by sub-frame generation unit 36 may be implemented in hardware, software, firmware, or any combination thereof. The implementation may be via a microprocessor, programmable logic device, or state machine. Components of the present invention may reside in software on one or more computer-readable mediums. The term computer-readable medium as used herein is defined to include any kind of memory, volatile or non-volatile, such as floppy disks, hard disks, CD-ROMs, flash memory, read-only memory (ROM), and random access memory.

In one form of the invention, sub-frames 30 have a lower resolution than image frame 28. Thus, sub-frames 30 are also referred to herein as low resolution images 30, and image frame 28 is also referred to herein as a high resolution image 28. It will be understood by persons of ordinary skill in the art that the terms low resolution and high resolution are used herein in a comparative fashion, and are not limited to any particular minimum or maximum number of pixels.

In one form of the invention, image display system 10 (FIG. 1) uses pulse width modulation (PWM) to generate light pulses of varying widths that are integrated over time to produce varying gray tones, and image shifter 38 (FIG. 1) includes a discrete micro-mirror device (DMD) array to produce sub-pixel shifting of displayed sub-frames 30 during a frame time. In one embodiment, as will be described in further detail below, the time slot for one frame (i.e., frame time or frame time slot) is divided among three colors (e.g., red, green, and blue) using a color wheel. The time slot available for a color per frame (i.e., color time slot) and the switching speed of the DMD array determines the number of levels and hence bits of grayscale obtainable per color for each frame. With two-position processing and four-position processing, which are described above, the time slots are further divided up into spatial positions of the DMD array. This means that the number of bits per position for two-position and four-position processing is less than the number of bits when such processing is not used. The greater the number of positions per frame, the greater the spatial resolution of the projected image. However, the greater the number of positions per frame, the smaller the number of bits per position, which can lead to contouring artifacts. The loss in bit-depth typically associated with two position processing and four position processing is described in further detail below with reference to FIGS. 5-8.

Figure 5:
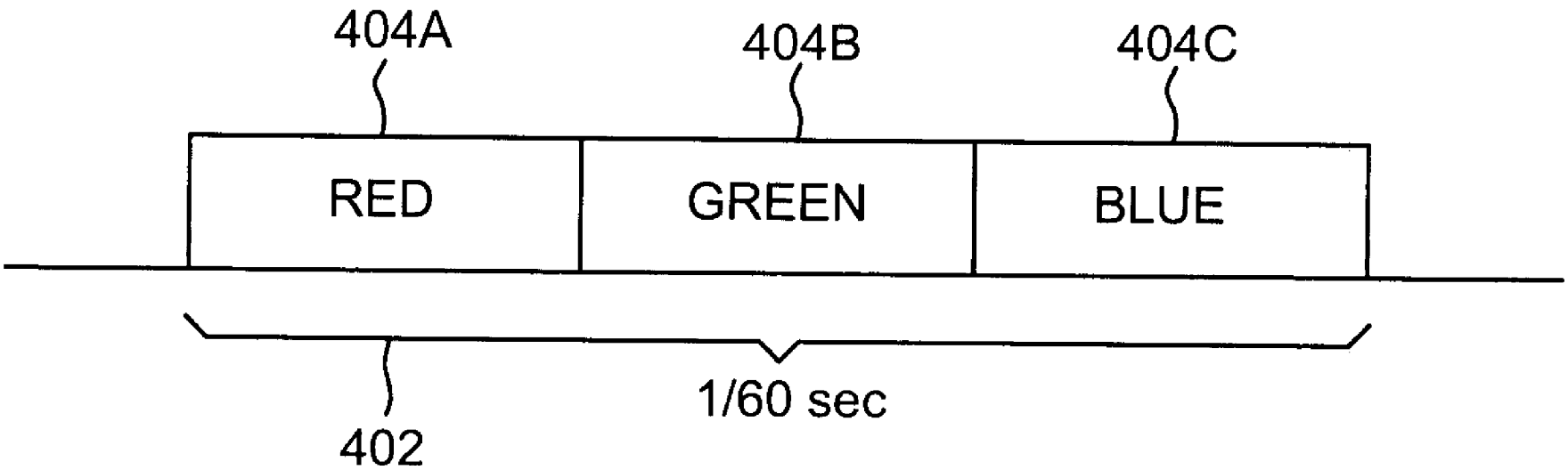
FIG. 5 is a diagram illustrating a frame time slot according to one embodiment of the present invention.

FIG. 5 is a diagram illustrating a frame time slot 402 according to one embodiment of the present invention. In the illustrated embodiment, the frame time slot 402 is $1/60^{th}$ of a second in length. Frame time slot 402 includes three color time slots 404A-404C (collectively referred to as color time slots 404). In the illustrated embodiment, time slot 404A is a red time slot, time slot 404B is a green time slot, and time slot 404C is a blue time slot. In the illustrated embodiment, the three color time slots 404 are of equal length (e.g., $1/180^{th}$ of a second). In another embodiment, the three color time slots 404 are of an unequal length. In yet another embodiment, more than three color time slots 404 are used, such as red, green, blue, and white color time slots.

In one embodiment, display device 26 uses an RGB (red-green-blue) color wheel to generate red, green, and blue light. Red time slot 404A represents the amount of time allocated to red light per frame. Green time slot 404B represents the amount of time allocated to green light per frame. Blue time slot 404C represents the amount of time allocated to blue light per frame.

The bit-depth for each of the three colors is dependent on the switching speed of the image shifter 38, and the fraction of the frame time slot 402 allocated to the color, as shown in the following Equation I:

$$B = \left\lfloor \log2\left(\frac{(1/60)g}{T_{switch}}\right)\right\rfloor \qquad \text{Equation I}$$

Where:

B=Number of bits for the color;

g=fraction of the frame time slot 402 allocated to the color; and $T_{switch}$=minimum switching time of the image shifter 38.

The symbol in Equation I that appears like a bracket surrounding the right side of the equation represents a "floor" operation. The result of the floor operation is the greatest integer that is less than or equal to the given value within the floor operation "brackets". Assuming that each of the three colors occupies one-third of the frame time slot 402 (i.e., g=⅓), and that the switching time, $T_{switch}$, of the image shifter 38 is twenty-one microseconds, Equation I indicates that the bit-depth for each of the three colors for this example is eight bits (i.e., B=8 bits). Some image shifters 38 may not be able to achieve a twenty-one microsecond switching time. Thus, assuming that the switching time, $T_{switch}$, is changed to forty-two microseconds, which is more reasonable for some image shifters 38, Equation I indicates that the bit-depth for each of the three colors is reduced to seven bits (i.e., B=7 bits), which reduces the number of light intensity levels per color by one-half.

Figure 6:
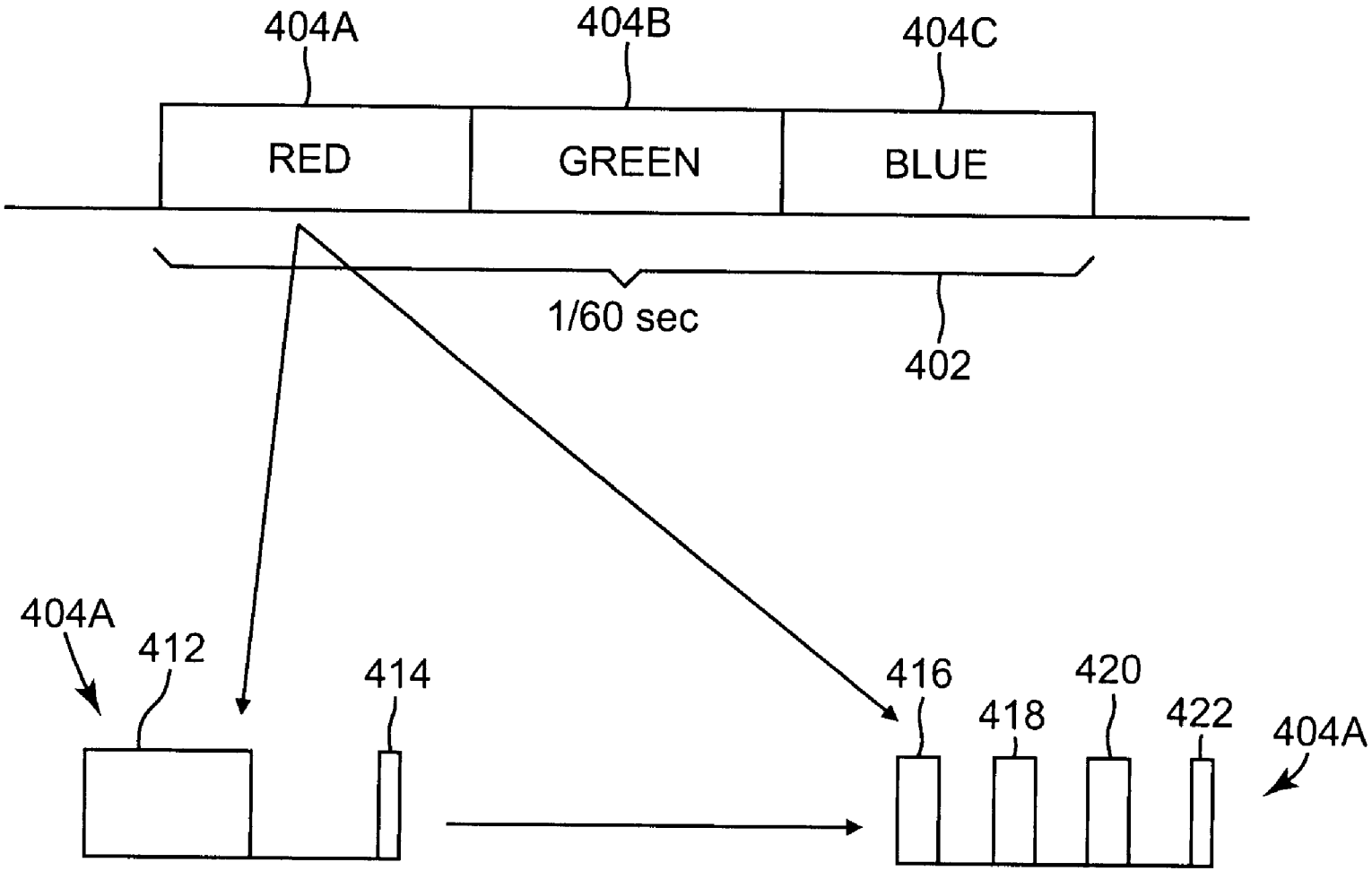
FIG. 6 is a diagram illustrating example sets of light pulses for one color time slot according to one embodiment of the present invention.

FIG. 6 is a diagram illustrating example sets of light pulses for one color time slot 404A according to one embodiment of the present invention. In one embodiment, display device 26 uses pulse-width modulation (PWM) to generate light pulses of varying widths (i.e., time durations), and thereby represent a variety of different light intensities. For the example shown in FIG. 6, a light intensity value of "9" for the red color time slot 404A is illustrated. The bit representation for a light intensity value of "9" is "1001" (i.e., $1*2^3+0*2^2+0*2^1+1*2^0=9$). The least significant bit in this example corresponds to a narrow light pulse 414. The on-time for the light pulse 414 corresponding to the least significant bit is referred to as the least significant bit (LSB) time. Thus, for example, if image shifter 38 has a minimum switching time, $T_{switch}$, of twenty-one microseconds, the LSB time will be twenty-one microseconds. Wider pulses have an on-time that is a multiple of the LSB time. The most significant bit in this example corresponds to a wider light pulse 412. The human visual system averages these two distinct pulses 412 and 414, so that the light intensity will appear to have a value of "9". Likewise, pulse-width modulation is used to generate desired light pulses for the green color time slot 404B and the blue color time slot 404C.

Using relatively wide light pulses and relatively narrow light pulses, such as light pulses 412 and 414, may cause flicker in the displayed images due to the low frequency of the switching. The human visual system is more sensitive to these lower frequencies. In one embodiment, image display system 10 uses bit-splitting to alleviate flicker. With bit-splitting, narrower light pulses are spread more evenly across the color time slot 404A to provide a higher frequency representation. For example, as shown in FIG. 6, the wide light pulse 412 is divided into three narrower light pulses 416, 418, and 420, which have a total on-time that is the same as the wide light pulse 412. In the illustrated embodiment, the narrow light pulse 422 is the same as the narrow light pulse 414. Thus, the total on-time of the light is the same for both cases, but the higher frequency of the light pulses 416-422 helps to alleviate flicker.

Figure 7:
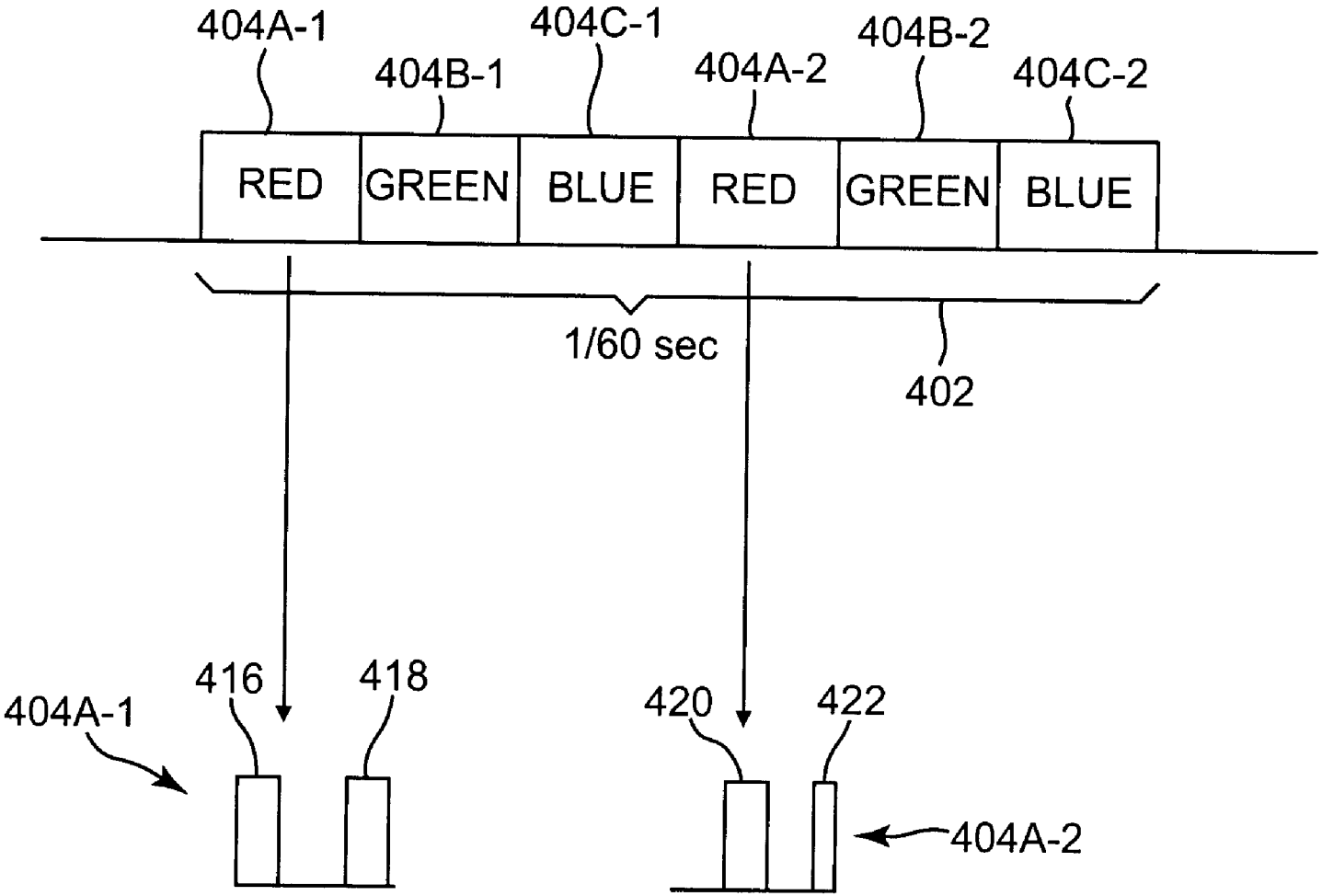
FIG. 7 is a diagram illustrating a frame time slot for a display system using 2× field sequential color (FSC) according to one embodiment of the present invention.

FIG. 7 is a diagram illustrating a frame time slot 402 for a display system 10 using 2× field sequential color (FSC) according to one embodiment of the present invention. In the illustrated embodiment, the frame time slot 402 is $1/60^{th}$ of a second in length. Frame time slot 402 includes six color time slots 404A-1, 404B-1, 404C-1, 404A-2, 404B-2, and 404C-2 (collectively referred to as color time slots 404). In the illustrated embodiment, time slots 404A-1 and 404A-2 are red time slots, time slots 404B-1 and 404B-2 are green time slots, and time slots 404C-1 and 404C-2 are blue time slots. In the illustrated embodiment, the six color time slots 404 are of equal length (e.g., $1/360^{th}$ of a second).

In one embodiment, display device 26 uses an RGB (red-green-blue) color wheel to generate red, green, and blue light, and the color wheel performs two complete rotations for each frame time slot 402, which is referred to as 2× field sequential color. Red time slots 404A-1 and 404A-2 represent the total amount of time allocated to red light per frame. Green time slots 404B-1 and 404B-2 represent the total amount of time allocated to green light per frame. Blue time slots 404C-1 and 404C-2 represent the total amount of time allocated to blue light per frame.

FIG. 7 also illustrates example sets of light pulses for red color time slots 404A-1 and 404A-2. The light pulses 416-422 shown in FIG. 7 are the same as the light pulses 416-422 shown in FIG. 6, and represent a light intensity value of "9". Since the time per frame allocated to the color red is shared by two red color time slots 404A-1 and 404A-2, two of the light pulses 416 and 418 are generated during time slot 404A-1, and the other two light pulses 420 and 422 are generated during time slot 404A-2.

Figure 8:
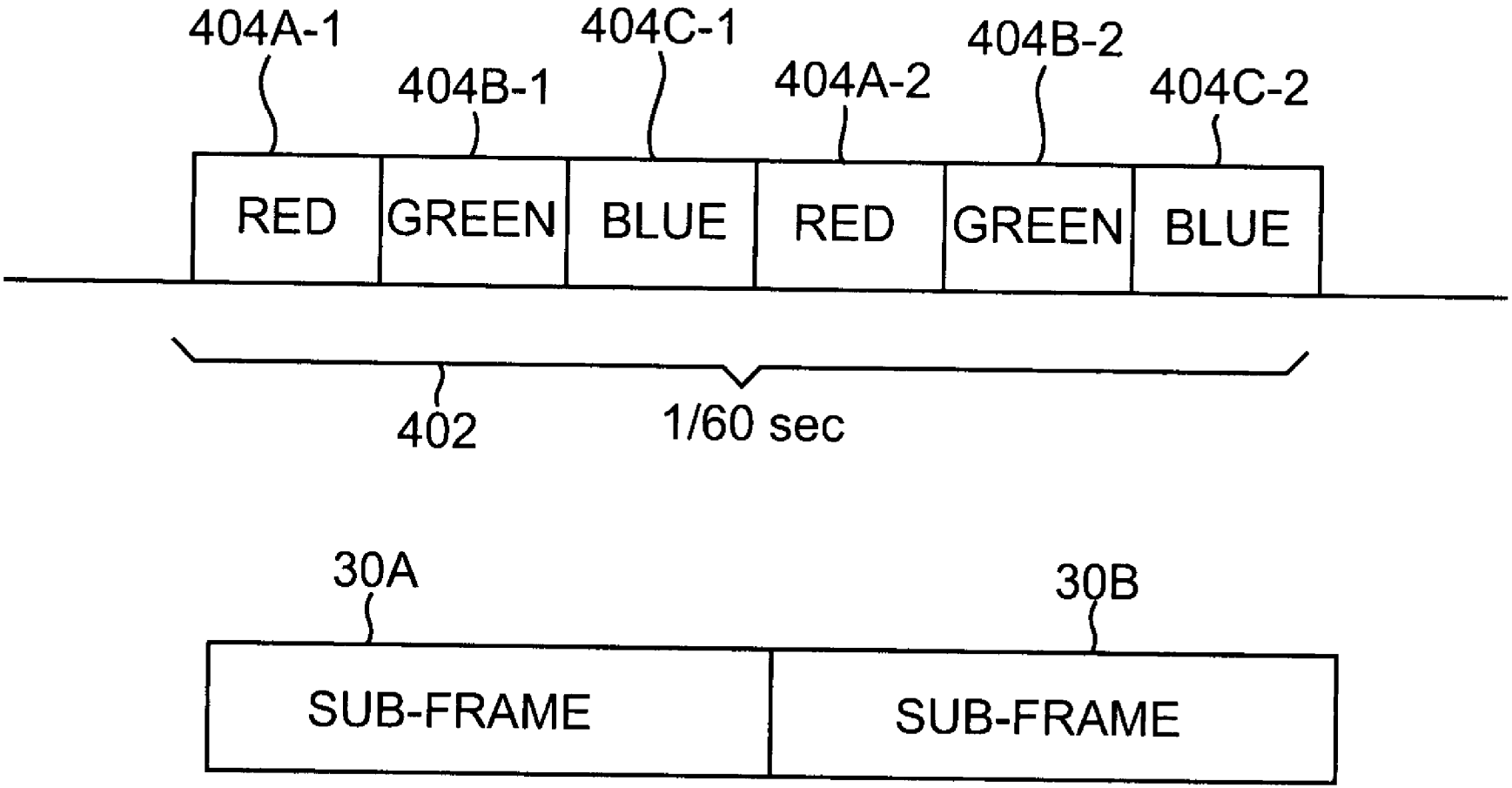
FIG. 8 is a diagram illustrating two sub-frames corresponding to a frame time slot according to one embodiment of the present invention.

FIG. 8 is a diagram illustrating two sub-frames 30A and 30B corresponding to the frame time slot 402 according to one embodiment of the present invention. In the illustrated embodiment, the frame time slot 402 is $1/60^{th}$ of a second in length, and the sub-frames 30A and 30B each occupy half of the frame time (i.e., $1/120^{th}$ of a second is allocated to each of the sub-frames 30A and 30B). Frame time slot 402 includes six color time slots 404A-1, 404B-1, 404C-1, 404A-2, 404B-2, and 404C-2 (collectively referred to as color time slots 404). In the illustrated embodiment, time slots 404A-1 and 404A-2 are red time slots, time slots 404B-1 and 404B-2 are green time slots, and time slots 404C-1 and 404C-2 are blue time slots. In the illustrated embodiment, the six color time slots 404 are of equal length (e.g., $1/360^{th}$ of a second). Time slots 404A-1, 404B-1, and 404C-1, correspond to sub-frame 30A, and time slots 404A-2, 404B-2, and 404C-2, correspond to sub-frame 30B.

As described above with reference to FIG. 5, for a switching time, $T_{switch}$, of twenty-one microseconds, the bit-depth for each of the three colors is eight bits. In one embodiment, with a bit-depth of eight bits, the maximum light intensity level that can be represented is a "252". When two-position processing or four-position processing is used, the bit-depth and the maximum light intensity level that can be represented are reduced, because the total number of bits for the frame time slot 402 is shared by two or more sub-frames.

For example, for two-position processing, each of the sub-frames 30A and 30B occupies half of the frame time slot 402, and uses half of the total number of bits for the frame time slot 402. Thus, for two-position processing and a switching time, $T_{switch}$, of twenty-one microseconds, the bit-depth per sub-frame 30A or 30B for each of the three colors is seven bits, and the maximum light intensity level that can be represented per sub-frame is "126".

As another example, for four-position processing, each of the sub-frames occupies one-fourth of the frame time slot 402, and uses one-fourth of the total number of bits for the frame time slot 402. Thus, for four-position processing and a switching time, $T_{switch}$, of twenty-one microseconds, the bit-depth per sub-frame for each of the three colors is six bits, and the maximum light intensity level that can be represented per sub-frame is "62".

This loss in bit-depth that typically accompanies fixed two-position processing or fixed four-position processing is avoided in one embodiment by providing a display system 10 that is configured to perform variable two-position processing, or variable four-position processing, as described in further detail below.

Figure 9:
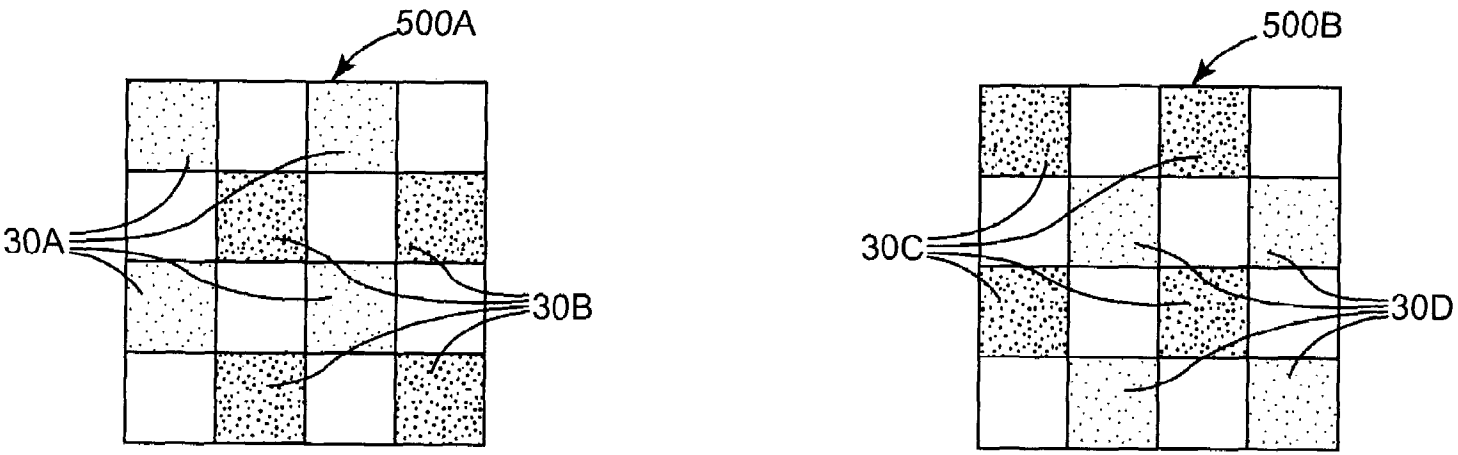
FIG. 9 is a diagram illustrating the display of sub-frames for consecutive frames based on fixed two-position processing according to one embodiment of the present invention.

FIG. 9 is a diagram illustrating the display of sub-frames 30 for consecutive frames 500A and 500B based on fixed two-position processing according to one embodiment of the present invention. Frame 500A is comprised of two sub-frames 30A and 30B, and the next consecutive frame 500B is comprised of two sub-frames 30C and 30D. The four elements shown in FIG. 9 for sub-frame 30A and the four elements for sub-frame 30B represent the top left corner locations of the corresponding pixels of the sub-frames 30A and 30B, respectively, displayed during the current frame period. The four elements shown in FIG. 9 for sub-frame 30C and the four elements for sub-frame 30D represent the top left corner locations of the corresponding pixels of the sub-frames 30C and 30D, respectively, displayed during the next frame period.

As shown in FIG. 9, sub-frame 30A is displayed in an upper left portion of the frame 500A, and sub-frame 30B is displayed in a lower right portion of the frame 500A. In the next frame 500B, sub-frame 30C is displayed in an upper left portion of the frame 500B, and sub-frame 30D is displayed in a lower right portion of the frame 500B. Thus, as illustrated in FIG. 9, the same two positions (upper left position and lower right position) are used for each frame 500A and 500B. The use of the same two positions for consecutive frames is referred to herein as fixed two position processing.

Figure 10:
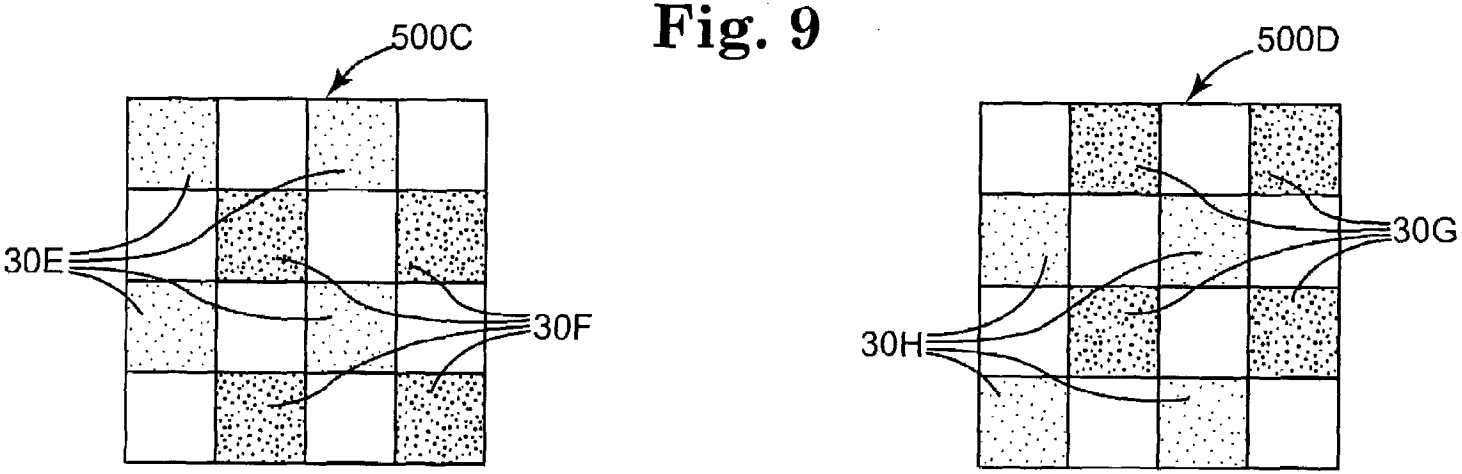
FIG. 10 is a diagram illustrating the display of sub-frames for consecutive frames based on variable two-position processing according to one embodiment of the present invention.

FIG. 10 is a diagram illustrating the display of sub-frames 30 for consecutive frames 500C and 500D based on variable two-position processing according to one embodiment of the present invention. Frame 500C is comprised of two sub-frames 30E and 30F, and the next consecutive frame 500D is comprised of two sub-frames 30G and 30H. The four elements shown in FIG. 10 for sub-frame 30E and the four elements for sub-frame 30F represent the top left corner locations of the corresponding pixels of the sub-frames 30E and 30F, respectively, displayed during the current frame period. The four elements shown in FIG. 9 for sub-frame 30G and the four elements for sub-frame 30H represent the top left corner locations of the corresponding pixels of the sub-frames 30G and 30H, respectively, displayed during the next frame period.

As shown in FIG. 10, sub-frame 30E is displayed in an upper left portion of the frame 500C, and sub-frame 30F is displayed in a lower right portion of the frame 500C. In the next frame 500D, sub-frame 30G is displayed in an upper right portion of the frame 500D, and sub-frame 30H is displayed in a lower left portion of the frame 500D. Thus, as illustrated in FIG. 10, a different set of two positions are used for consecutive frames 500C and 500D. The use of different sets of two positions for consecutive frames is referred to herein as variable two-position processing. Similarly, the use of different sets of four-positions for consecutive frames is referred to herein as variable four-position processing.

One form of the present invention simulates an increased position display system that uses more positions/frame, using successive frames that have fewer positions/frame. A display system 10 according to one embodiment uses more bits/color/frame than an increased position display system, thereby providing reduced contouring artifacts. One embodiment of the present invention achieves improved spatial resolution over a display system that uses the same positions for every frame.

One form of the present invention uses fewer position processing (e.g., two-position processing), and yet produces results comparable with a system using increased positions (e.g., four-position processing), without the corresponding loss in bit-depth typically associated with the increased position processing. One form of the present invention is a system 10 that is configured to perform M×N (e.g., 2×2=4) position processing, but only M (e.g., 2) positions are used in each frame, where N and M are integers. The remaining (M×N−M) positions are used for N−1 successive frames, using M positions per frame. Due to temporal averaging of the human visual system, the display system 10 according this embodiment is perceived to have increased spatial resolution over a display system that uses the same M positions every frame. In addition, the display system 10 according to this embodiment does not have the loss in bit-depth that typically occurs with a system that uses the same M×N positions every frame. A display system 10 according to one embodiment of the invention is configured to perform four-position processing, but uses two-positioning processing per frame, with the two positions used alternating between frames.

Although specific embodiments have been illustrated and described herein for purposes of description of the preferred embodiment, it will be appreciated by those of ordinary skill in the art that a wide variety of alternate or equivalent implementations may be substituted for the specific embodiments shown and described without departing from the scope of the present invention. Those with skill in the mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A method of displaying images with a display device, the method comprising:

receiving image data for a plurality of image frames;

generating at least one sub-frame for each image frame based on the received image data;

displaying the sub-frames for each image frame in a first set of the plurality of image frames at a first plurality of spatially offset positions;

displaying the sub-frames for each image frame in a second set of the plurality of image frames at a second plurality of spatially offset positions that is different than the first plurality of spatially offset positions; and sequentially displaying a plurality of colors during the display of each of the sub-frames.

2. The method of claim 1, wherein the sub-frames for each image frame are displayed with a temporal offset.

3. The method of claim 1, wherein the sub-frames for consecutive image frames are displayed at different pluralities of spatially offset positions.

4. The method of claim 1, wherein the first and the second pluralities of spatially offset positions each include two positions.

5. The method of claim 4, wherein the first plurality of spatially offset positions includes a first position, and a second position diagonally offset from the first position in a first diagonal direction.

6. The method of claim 5, wherein the second plurality of spatially offset positions includes a third position spatially offset from the first and the second positions, and a fourth position diagonally offset from the third position in a second diagonal direction that is substantially perpendicular to the first diagonal direction.

7. The method of claim 1, wherein the first and the second pluralities of spatially offset positions each include four positions.

8. A system for displaying images, the system comprising:

a buffer adapted to receive image data for first and second images;

an image processing unit configured to define first and second sub-frames corresponding to the first image, and define third and fourth sub-frames corresponding to the second image; and a display device adapted to alternately display the first sub-frame in a first position and the second sub-frame in a second position spatially offset from the first position, and alternately display the third sub-frame in a third position spatially offset from the first position and the second position, and the fourth sub-frame in a fourth position spatially offset from the first position, the second position, and the third position, wherein the display device is adapted to use pulse-width modulation to represent different light intensities in the displayed sub-frames.

9. The system of claim 8, wherein the second position is diagonally offset from the first position in a first diagonal direction.

10. The system of claim 9, wherein the fourth position is diagonally offset from the third position in a second diagonal direction that is substantially perpendicular to the first diagonal direction.

11. The system of claim 8, wherein the image processing unit is configured to define a first set of four sub-frames corresponding to the first image, and define a second set of four sub-frames corresponding to the second image, and wherein the display device is adapted to alternately display the first set of four sub-frames in a first set of four spatially offset positions, and alternately display the second set of four sub-frames in a second set of four spatially offset positions that is different than the first set of four spatially offset positions.

12. A system for displaying low resolution sub-frames at spatially offset positions to generate the appearance of a high resolution image, the system comprising:

means for receiving a set of consecutive high resolution images;

means for generating a plurality of low resolution sub-frames for each of the high resolution images;

means for alternately displaying the low resolution sub-frames for each of the high resolution images at a set of spatially offset positions;

means for automatically varying the set of spatially offset positions for at least one of the high resolution images; and means for sequentially displaying a plurality of colors during the display of each of the low-resolution sub-frames.

13. The system of claim 12, wherein the means for varying is configured to vary the set of spatially offset positions such that the sub-frames for consecutive high resolution images are displayed at different sets of spatially offset positions.

14. The system of claim 12, wherein the means for generating is configured to generate two sub-frames for each of the high resolution images, and wherein the means for alternately displaying is configured to display the two low resolution sub-frames for each of the high resolution images at a set of two spatially offset positions.

15. The system of claim 14, wherein the means for varying is configured to vary the set of spatially offset positions such that the sub-frames for consecutive high resolution images are displayed at different sets of two spatially offset positions.

16. The system of claim 15, wherein the different sets of two spatially offset positions include a first set and a second set, the first set including a first position, and a second position diagonally offset from the first position in a first diagonal direction, the second set including a third position spatially offset from the first and the second positions, and a fourth position diagonally offset from the third position in a second diagonal direction that is substantially perpendicular to the first diagonal direction.

17. The system of claim 12, wherein the means for generating is configured to generate four sub-frames for each of the high resolution images, and wherein the means for alternately displaying is configured to display the four low resolution sub-frames for each of the high resolution images at a set of four spatially offset positions.

18. The system of claim 17, wherein the means for varying is configured to vary the set of spatially offset positions such that the sub-frames for consecutive high resolution images are displayed at different sets of four spatially offset positions.

19. A computer-readable medium storing computer-executable instructions for performing a method of displaying low resolution sub-frames at spatially offset positions to generate the appearance of a high resolution image, comprising:

receiving a set of consecutive high resolution images;

generating a set of low resolution sub-frames for each of the high resolution images;

alternately displaying the low resolution sub-frames for each of the high resolution images at a plurality of spatially offset positions;

automatically varying the plurality of spatially offset positions for at least one of the high resolution images; and generating light pulses of varying widths to represent different light intensities in the displayed low resolution sub-frames.

20. The computer-readable medium of claim 19, wherein the plurality of spatially offset positions are varied such that the sub-frames for consecutive high resolution images are displayed at different spatially offset positions.

* * * * *